US008813870B2

(12) United States Patent
Jiao et al.

(10) Patent No.: US 8,813,870 B2
(45) Date of Patent: Aug. 26, 2014

(54) ARRANGEMENT AND A METHOD FOR MONITORING AN AIR FLOW IN A DRILL RIG

(75) Inventors: Deyi Jiao, Plano, TX (US); Per Krainer, Ludvika (SE)

(73) Assignees: Atlas Copco Rock Drills AB, Orebro (SE); Atlas Copco Drilling Solutions LLC, Garland, TX (US)

( * ) Notice: Subject to any disclaimer, the term of this patent is extended or adjusted under 35 U.S.C. 154(b) by 463 days.

(21) Appl. No.: 12/736,738

(22) PCT Filed: Apr. 29, 2009

(86) PCT No.: PCT/US2009/002668

§ 371 (c)(1),
(2), (4) Date: Nov. 3, 2010

(87) PCT Pub. No.: WO2009/139825

PCT Pub. Date: Nov. 19, 2009

(65) Prior Publication Data

US 2011/0056749 A1 Mar. 10, 2011

(30) Foreign Application Priority Data

May 13, 2008 (WO) ..... PCT/US2008/006075

(51) Int. Cl.

| | |
|---|---|
| ***E21B 21/08*** | (2006.01) |
| ***E21B 21/16*** | (2006.01) |
| ***E21B 7/02*** | (2006.01) |
| ***E21B 44/02*** | (2006.01) |

(52) U.S. Cl.

CPC ..... *E21B 7/022* (2013.01); *E21B 21/16* (2013.01); *E21B 44/02* (2013.01); *E21B 21/08* (2013.01)

USPC ..... 175/48; 175/40; 175/65; 175/71; 175/212; 173/177

(58) Field of Classification Search

CPC ..... E21B 10/18; E21B 10/38; E21B 21/00; E21B 21/08; E21B 21/16; E21B 41/0078; E21B 2010/60; E21B 2021/00; E21B 2021/005

USPC ..... 175/40, 48, 65, 71, 212; 173/1, 177

See application file for complete search history.

(56) References Cited

U.S. PATENT DOCUMENTS 3,268,017 A * 8/1966 Yarbrough ..... 175/25
3,463,252 A * 8/1969 Garrett et al. ..... 175/27

(Continued)

FOREIGN PATENT DOCUMENTS

DE 3 229 487 A 2/1984
WO WO 2007/122288 A 11/2007

*Primary Examiner* — Jennifer H Gay
*Assistant Examiner* — Elizabeth Gitlin
(74) *Attorney, Agent, or Firm* — Mark P. Stone

(57) ABSTRACT

An arrangement in a rock drill rig 10 has an inlet valve 31 arranged upstream from a displacement compressor 32 that is used for supplying an air flow 34 to at least one flushing hole 23 in the surface of a drill bit 20. The rock drill rig 10 also has an air regulator 35 arranged to regulate the system pressure in the air flow path 34 downstream from the compressor and a detector for detecting air flow through the at least one flushing hole 23 in the surface of the drill bit. The detector has a pressure sensor 36, arranged between the air regulator 35 and the inlet valve 31, for measuring the reduced system pressure.

5 Claims, 4 Drawing Sheets

(56) References Cited

U.S. PATENT DOCUMENTS

| | | | | | |
|---|---|---|---|---|---|
| 3,493,059 | A | * | 2/1970 | Cox | 175/24 |
| 3,596,720 | A | * | 8/1971 | Elenburg | 175/69 |
| 3,774,701 | A | * | 11/1973 | Weaver | 175/17 |
| 4,457,375 | A | * | 7/1984 | Cummins | 166/309 |
| 4,653,593 | A | * | 3/1987 | Lindberg | 173/1 |
| 4,793,421 | A | * | 12/1988 | Jasinski | 175/27 |
| 4,836,305 | A | * | 6/1989 | Curlett | 175/215 |
| 4,924,949 | A | * | 5/1990 | Curlett | 175/25 |
| 5,409,072 | A | * | 4/1995 | Enlund et al. | 175/71 |
| 2004/0173379 | A1 | * | 9/2004 | Leppanen | 175/57 |
| 2007/0246262 | A1 | * | 10/2007 | Brookover | 175/27 |

* cited by examiner

ARRANGEMENT AND A METHOD FOR MONITORING AN AIR FLOW IN A DRILL RIG

The present application claims the benefit of International Patent Application PCT/US2008/006075, filed in the United States Receiving Office on May 13, 2008, pursuant to 35 U.S.C. Section 365.

TECHNICAL FIELD

The present invention relates to an arrangement in a drill rig and to a method of detecting a reduced air flow through a flushing hole in a drill bit.

BACKGROUND ART

Drill rigs indifferent sizes are frequently used in constructional work to drill holes in rocks. The drill rig comprises a rock drilling machine with a drill bit adapted for the specific conditions of the rock and used to penetrate the rock, and chip away the fractured rocks. The penetration force is generated by either a high level feed force or percussive wave forms. The rotation torque generated by a rotation motor will shear off the fractured rock.

In surface rock drilling processes, it is standard practice to use compressed air to blow away the rock cuttings and clean the surface of the rock to ensure that the drill bit always is in contact with a fresh and solid rock surface. If the cuttings were not cleaned away, the drill bit would penetrate the cuttings and further break down the cuttings into smaller sizes. This secondary breakage is not wanted because of the considerable quantity of waste energy and reduced drilling efficiency. The accumulation of the cuttings will furthermore resist the rotation of the drill bit and eventually jam the drill bit to stop.

A drill bit comprises flushing holes and compressed air is arranged to flow out through the holes during drilling. The flow of air is however stopped if the flushing holes get plugged by mud or if fine cuttings are compacted into the flushing holes. The ground condition where the rock drill works varies widely and the existence of mud in the ground substantially increases the risk of plugged holes. When the ground is soft while drilling rate is so fast that the air provided is not sufficient to clean the cuttings away, the drill bit is plugged by impacting the fine cuttings into the flushing hole.

When the flushing holes are plugged, the drill bit gets stuck and then the drilling is completely stopped. Then, the drill hole must be cleaned which takes a considerable time. It may involve pulling out the whole drill string. Consequently, it is important to ensure a continuous air flow through the flushing holes of the drill bit.

A commonly used method of detecting a reduced or stopped air flow in the flushing holes of a drill bit is to arrange an air flow monitoring device e.g. a venturi flow nozzle in the air flow path downstream a compressor. A low differential pressure is generated by such a device, in the range of a few psi while the working pressure is much higher. This normally means a differential pressure of less than 5 psi. A certain differential pressure indicates a normal air flow through the holes. When the certain differential pressure disappears, it indicates a stopped air flow. A mechanical or electrical device comprising a switch is used to detect a differential pressure and to send out a signal to a control unit to e.g. reverse the feed of air and stop the drilling. The creation and detection of a differential pressure puts demand on high sensitivity and high accuracy since the device used is working in a comparatively very high pressure environment.

Accordingly, prior art arrangements require a detection device having a very high sensitivity for detecting small pressure changes in a relatively high pressure environment. This kind of electrical and/or mechanical devices are very expensive and have high maintenance cost.

Furthermore, prior art monitoring devices give rise to a pressure drop in the air flow path which will have a negative impact on the air flow out through the flushing holes in the drill bit. It also has a negative impact on energy consumption.

Thus, there are needs to improve arrangements and methods for detecting a reduced, or stopped, air flow through the flushing holes of a drill bit in a rock drill rig.

SUMMARY OF THE INVENTION

The aim of the invention is to remedy the above mentioned drawbacks with air flow monitoring device as mentioned above.

The above problem is according to the first aspect of the invention solved in that an arrangement of the kind in question has the specific features that it comprises a rock drill rig comprising an air inlet valve arranged in a flow path upstream to a displacement compressor that is used for supplying an air flow to at least one flushing hole in the surface of a drill bit. The drill rig further comprises an air regulator arranged to regulate the system pressure in an air flow path downstream the compressor and means for detecting a changed flow of air through the at least one flushing hole in the surface of the drill bit. The detecting means comprises a pressure sensor arranged between the air regulator and the inlet valve and the sensor is adapted to measure the reduced system pressure.

The solution according to the invention makes it possible to arrange a point for monitoring the flow of air through the flushing holes in the drill bit upstream of the compressor. Through measuring the reduced system pressure and knowing the inlet valve, the air flow rate through the system is indirectly monitored.

Generally, a pressure regulator comprises an unloader cylinder which senses the reduced system pressure caused by flow changes in the system. The pressure regulator has a wide pressure changing range and this is why we use this feature for the air sensing.

The inlet valve is arranged to work against atmospheric pressure and the inlet valve opening area is inversely proportional to the differential pressure.

Knowing the reduced system pressure and the characteristic of the inlet valve leads to the pressure between the inlet valve and the compressor.

The pressure changes at the regulator is inversely proportional to the air flow rate downstream the compressor. Accordingly, the monitored reduced system pressure is inversely proportional to the system air flow rate.

The reduced system pressure is around 0-40 psi while the air system pressure is between 100-150 psi. The solution according to the invention provides a measurement resolution and an accuracy, which is extremely high compared to prior art arrangements.

Additionally, it is practically easier to measure the reduced system pressure between the regulator and the inlet valve than between the inlet valve and the compressor. Further, the pressure between the inlet valve and the compressor is a negative pressure and measuring a negative pressure demands a more complicated and expensive equipment.

The solution according to the invention makes it possible to use relatively inexpensive standard sensors because resolution and accuracy of the sensor is not required to achieve same or better performance for the same air monitoring functions. This results in an arrangement having better performance at a lower price since pressure sensors provide reliable measuring results, and are less complex components that are readily available and easy to install.

A further advantage is that the amount of components is reduced compared to prior art solutions e.g. there is no device giving rise to a pressure drop in the air flow path. This has a positive impact on the energy consumption.

According to one embodiment of the invention, the displacement compressor is a screw compressor or any type of displacement compressor.

According to one embodiment of the invention, the displacement compressor is a rotary compressor with constant rotation speed.

According to one embodiment of the invention, the displacement compressor (32) is a rotary compressor with variable rotation speed.

The above problem is according to the second aspect of the invention solved in that a method of the kind in question has the specific features that it comprises detecting an air flow rate through at least one flushing hole in a front surface of a drilling bit arranged in a rock drill rig. The rock drill rig comprises an inlet valve arranged upstream a displacement compressor that is used for supplying an air flow to the at least one flushing hole in the drill bit. The drill rig further comprises an air pressure regulator arranged to regulate the system pressure in the air flow path downstream the compressor. The method comprises measuring a reduced system pressure between the regulator and the inlet valve. Further, the method comprises detecting the air flow rate through the drill bit based on the fact that the measured reduced system pressure is inversely proportional to the air flow rate.

This is based on a constant rotation speed of the compressor and the fact that the system air flow is dependent on the compressor speed rotation.

An embodiment is a method comprising comparing the determined air flow rate with a predetermined value. If the determined air flow rate is lower than the predetermined value, send a signal to a control unit to reduce the speed of the drill bit or to stop drilling. Further, if the determined air flow rate is equal or higher than the predetermined value, send a signal to the control unit to continue drilling. The method is repeated at predetermined intervals in order to control the flushing during drilling.

By considering a variable rotational speed of a compressor, the solution according to the invention teaches the air flow in other working points.

BRIEF DESCRIPTION OF THE DRAWING

One embodiment of the present claimed invention is schematically illustrated in the appended figure, in which:

DESCRIPTION OF ALTERNATIVE EMBODIMENTS

Figure 1:
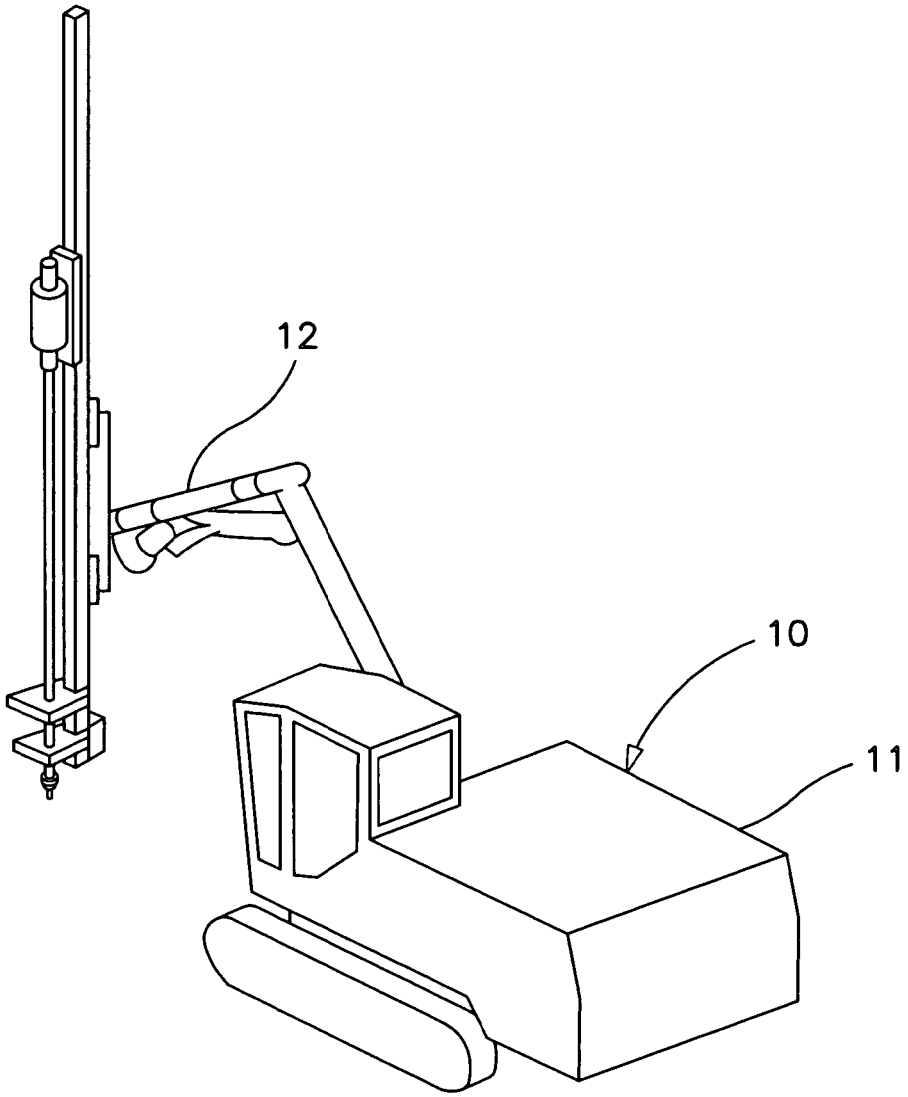
FIG. 1 is a drill rig in which the claimed arrangement is used.

In FIG. 1 a surface rock drill rig 10 is illustrated. The rig 10 is used for hole drilling in different types of constructional or mining work. The rig 10 comprises a rig body 11 that comprises machinery for enabling transport of the rig, as well as for providing the required power to conduct the drilling and a displacement compressor (not shown). The drill is placed in the outer end of an elongated arm 12 that extend forward from the rig body 11. The arm is manoeuvrable to be easily movable to the intended position of the hole.

Figure 2:
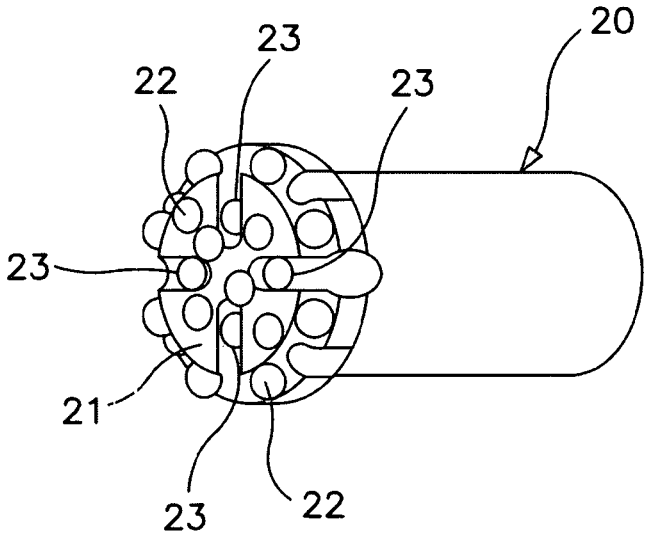
FIG. 2 is a perspective view of a drill bit.

A drill bit 20, illustrated in FIG. 2, is used for penetrating the rock and chip away the fractured rocks. The front surface 21 of the drill bit 20 is provided with a number of drill elements 22 used for penetrating the rock. The front surface is furthermore provided with four flushing holes 23. Compressed air, provided from the displacement compressor in the rig body 11, is flowing out from the flushing holes 23 in order to blow the rock cuttings away and clean the surface of the rock. This ensures that the drill bit 20 always is in contact with fresh and solid rock surface in order to keep the drilled hole free from already cut rock.

Figure 3:
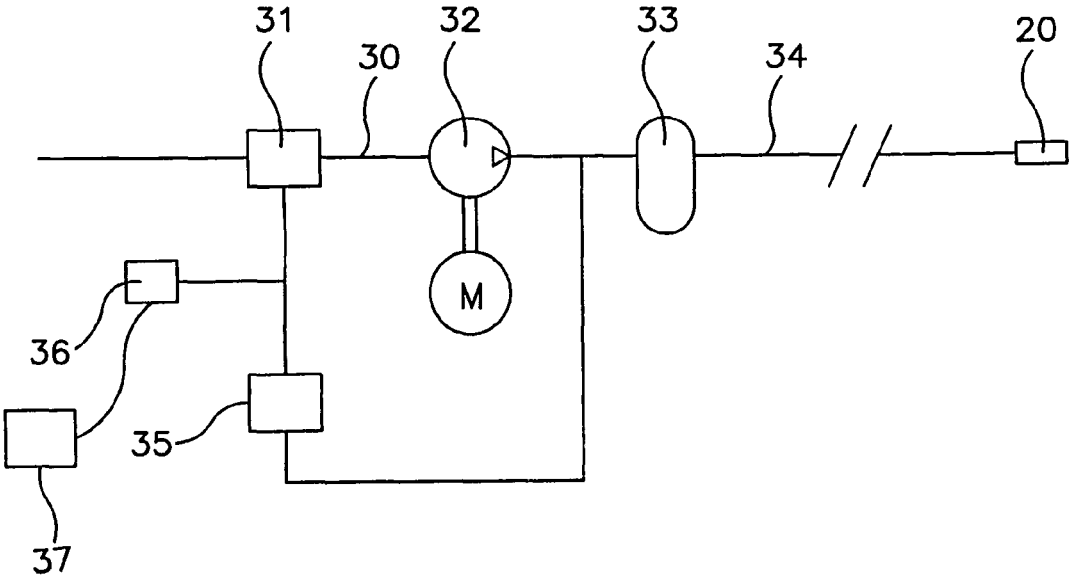
FIG. 3 is the claimed arrangement schematically disclosed.

FIG. 3 is a part of a drill rig air system schematically disclosed. The system comprises an air inlet flow path 30 through which air to a compressor 32, powered by a power source M, is lead via an inlet valve 31. Compressed air from the compressor 32 is passed on to a pressure vessel 33. Air is fed from the pressure vessel 33 via an air flow path 34 to the drill bit 20 where it exits the bit via the flushing holes 23. An air regulator 35 is arranged to regulate the inlet air valve 31 to regulate the air system pressure which the compressor produces in the air flow path 34 downstream the compressor.

The inlet valve 31 is used for regulating the quantity of air supplied to the compressor 32 in order to avoid the system pressure from rising when the air flow through the flushing holes 23 in the drill bit 20 are plugged.

The system further comprises a pressure sensor 36 arranged between the regulator 35 and the inlet valve 31. The pressure sensor is adapted to measure the reduced system pressure and to send a corresponding signal to a control unit 37. The air flow rate through the drill bit 20 is determined based on the fact that the measured reduced system pressure is inversely proportional to the air flow rate.

Where the displacement compressor 32 is a rotary compressor with variable rotation speed, the method is based on a desired rotation speed in each working point.

If the determined air flow rate is lower than a predetermined value, the speed of the drill bit is reduced and/or the drilling is stopped.

If the determined air flow rate is equal or higher than a predetermined value, the drilling is continued.

Figure 4:
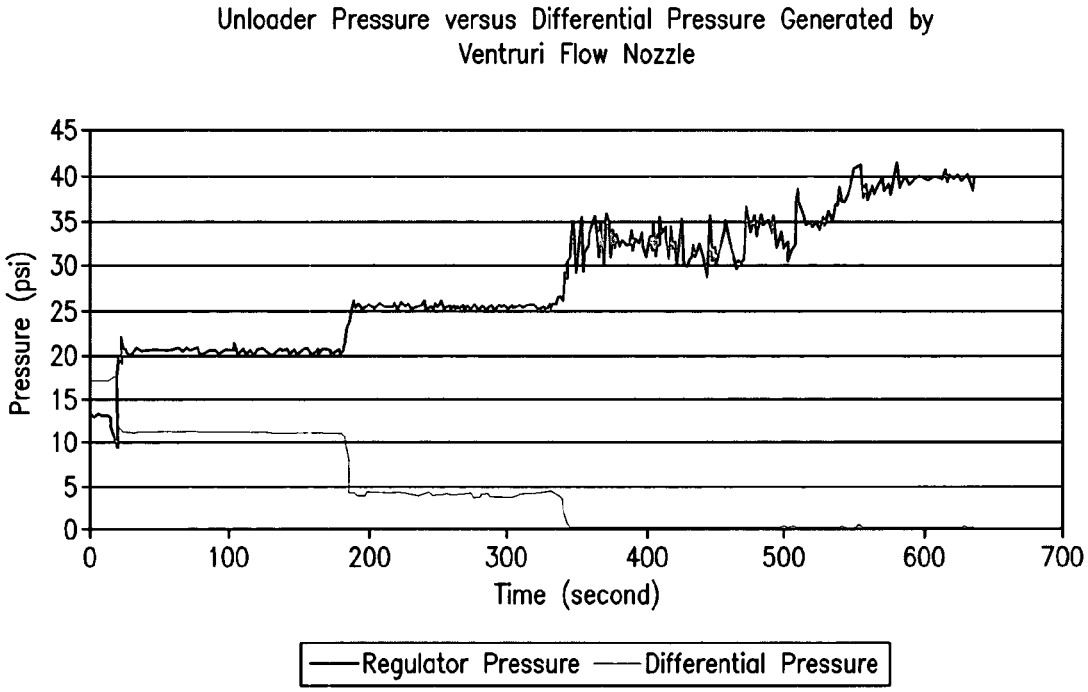
FIG. 4 is a diagram showing the reduced system pressure changes (denoted unloader pressure) versus differential pressure generated by venture flow nozzle.

FIG. 4 is a chart showing the result of a test done on a surface rock drill rig comprising a venturi flow nozzle. The diagram shows the relationship between the reduced system pressure (denoted unloader pressure) and the air flow rate. The flow rate is indicated by differential pressure created by air flow through the venture flow nozzle device. The differential pressure is proportional to the flow rate.

When the air flow reaches zero, the reduced system pressure reaches its highest level. This reduced system pressure is about 30% of the system pressure and is much higher pressure than commonly used venture tube generated differential pressure. The difference between the full flow and zero flow conditions is very easily detected by monitoring the reduced system pressure changes. An economical and simple pressure sensor can so be used for detecting the air flow status.

The reduced system pressure is highest when the differential pressure is close to zero i.e. when the air flow through the flushing holes is close to zero.

The reduced system pressure is lowest when the differential pressure is highest i.e. when the air flow through the flushing holes is full and the inlet valve is fully open.

Accordingly, if the air through the flushing holes 23 stops, the air regulator 35 closes the inlet air valve 31 to prevent the system pressure from going up. This is achieved in that the inlet valve is controlled by the reduced system pressure.

According to the invention, the pressure sensor is measuring the reduced air system pressure and thereby indirectly monitoring the flow rate of air through the flushing holes.

According to the present invention, both pressure and compressor speed rotation are considered and therefore the air flow rate is completely controlled.

A consequence of the present invention is that with a given pressure in the air inlet path and varying the compressor speed rotation, the air flow rate will vary linearly with the compressor speed rotation.

The invention claimed is:

1. An arrangement in a rock drill rig comprising an inlet valve arranged upstream a displacement compressor that is used for supplying an air flow to at least one flushing hole in the surface of a drill bit, the drill rig further comprising an air regulator arranged to regulate the system pressure in the air flow path downstream the compressor and means for detecting a flow of air through the at least one flushing hole in the surface of the drill bit, wherein the means for detecting comprises a pressure sensor arranged between the air regulator and the inlet valve and adapted to directly measure the reduced system pressure, said arrangement further including means for controlling the speed of the drill bit based upon the detected air flow through said at least one flushing hole in the drill bit.

2. An arrangement according to claim 1, wherein the displacement compressor is a rotary compressor with constant rotation speed.

3. An arrangement according to claim 1, wherein the displacement compressor is a rotary compressor with variable rotation speed.

4. A method of detecting an air flow rate through at least one flushing hole in a front surface of a drilling bit arranged in a rock drill rig comprising an inlet valve arranged upstream a displacement compressor that is used for supplying an air flow to the at least one flushing hole in the drill bit, the drill rig further comprises a regulator arranged to regulate the system pressure in the air flow path downstream the compressor, the method comprising the steps of:

directly measuring a reduced system pressure between the regulator and the inlet valve, determining the air flow rate through the drill bit based on the fact the measured reduced system pressure is inversely proportional to the air flow rate, comparing the determined air flow rate with a predetermined value, and if the determined air flow rate is lower than the predetermined value reducing the seed of the drill bit or stopping drilling, or if the determined air flow rate is equal or higher than the predetermined value, continuing drilling.

5. A method according to claim 4, comprising the step of setting a desired compressor rotation speed.

* * * * *

UNITED STATES PATENT AND TRADEMARK OFFICE

CERTIFICATE OF CORRECTION

PATENT NO. : 8,813,870 B2
APPLICATION NO. : 12/736738
DATED : August 26, 2014
INVENTOR(S) : Deyi Jiao and Per Krainer It is certified that error appears in the above-identified patent and that said Letters Patent is hereby corrected as shown below:

In the Claims

Column 6, Line 24 (Claim 4, Line 16): After "value", add --,--.

Column 6, Line 24 (Claim 4, Line 16): Delete "seed", and substitute --speed--.

Signed and Sealed this
Fourth Day of November, 2014

Michelle K. Lee

Michelle K. Lee
*Deputy Director of the United States Patent and Trademark Office*